US008084681B2

(12) United States Patent
Schon

(10) Patent No.: US 8,084,681 B2
(45) Date of Patent: Dec. 27, 2011

(54) DISTORTION PEDAL

(76) Inventor: Neal Schon, San Francisco, CA (US)

( * ) Notice: Subject to any disclaimer, the term of this patent is extended or adjusted under 35 U.S.C. 154(b) by 0 days.

(21) Appl. No.: 12/791,760

(22) Filed: Jun. 1, 2010

(65) Prior Publication Data

US 2010/0300273 A1 Dec. 2, 2010

Related U.S. Application Data

(60) Provisional application No. 61/182,654, filed on May 29, 2009.

(51) Int. Cl.
*G10H 1/32* (2006.01)
*G10H 3/00* (2006.01)

(52) U.S. Cl. ..... 84/746; 84/615; 84/653; 84/721; 84/723; 84/742

(58) Field of Classification Search ..... None
See application file for complete search history.

(56) References Cited

U.S. PATENT DOCUMENTS

| | | | | |
|---|---|---|---|---|
| 3,317,649 | A * | 5/1967 | Hearne | 84/713 |
| 5,977,474 | A * | 11/1999 | O'Brien | 84/735 |
| 6,034,316 | A * | 3/2000 | Hoover | 84/738 |
| 6,376,761 | B1 * | 4/2002 | LaMarra et al. | 84/670 |
| 6,998,528 | B1 * | 2/2006 | Limacher et al. | 84/662 |
| 2008/0173164 | A1 * | 7/2008 | Francis et al. | 84/721 |
| 2010/0300273 | A1 * | 12/2010 | Schon | 84/746 |

* cited by examiner

*Primary Examiner* — Marlo Fletcher
(74) *Attorney, Agent, or Firm* — Dergosits & Noah LLP; Todd A. Noah

(57) ABSTRACT

A combination distortion pedal and amplifier includes a foot pedal controls the distortion and the amplification of audio signals. The level of distortion and amplification are determined by the position of the foot pedal with a low level of distortion and amplification when the foot pedal is in a released position and a high level of distortion and amplification when the foot pedal is depressed. Various intermediate distortion and amplification levels are provided when the foot pedal is in positions between fully released and fully depressed.

4 Claims, 4 Drawing Sheets

DISTORTION PEDAL

CROSS REFERENCE TO RELATED APPLICATIONS

This application claims priority to provisional patent application No. 61/182,654, DISTORTION PEDAL, filed May 29, 2009 which is hereby incorporated by reference.

BACKGROUND

With reference to FIG. 1, a top view of a distortion pedal 101 is illustrated. The distortion pedal 101 includes a tone control 105, a distortion control 107 and a on/off pedal 111. The distortion pedal 101 is used with an electric guitar to distort the audio signals produced by the guitar. An audio cable is connected between the output of the guitar and the input 109 of the distortion pedal 101. The distortion pedal 101 has a pedal 111 that switches the distortion pedal 101 between on and off modes. In the off mode, the audio signals can go through the distortion pedal 101 without being modified and in the on mode, the distortion pedal 101 modifies the audio signals to the tone and distortion levels set by the tone control 105 and the distortion control 107. The distortion pedal 111 audio processing is either on or off. Because guitar requires two hands to play, it is not possible to adjust the tone by rotating the tone control 105 or the distortion levels by rotating the distortion control 107 while the user is playing. What is needed is an improved distortion pedal that allows the distortion controls to be adjusted with the user's feet while the guitar is being played.

SUMMARY OF THE INVENTION

A distortion pedal includes a variable tone or audio distortion control and a variable amplification control that can both be controlled by a foot pedal. In an embodiment, the input audio signals are processed by the tone and amplifier controls. When the foot pedal is pressed, the maximum distortion and the maximum amplification can be applied to the input audio signals. Conversely, when the foot pedal is released, a minimum distortion and minimum amplification can be applied to the audio signals. In an embodiment, the maximum variable distortion and amplification levels are set using control knobs on the distortion pedal. The distortion and amplification applied to the audio signals is then controlled between the set maximum values and minimum values such as no distortion/amplification by the position of the foot pedal.

The distortion pedal may also include a DB line boost that can be controlled by a control knob that sets the amplification level. An on/off button controls the amplification of the audio signals. The processed audio signals are then output through the output connector. In an embodiment, audio signals from an electric instrument or microphone are transmitted to the input of the distortion pedal. The processed audio signals are then output to an additional power amplifier and speakers which emit the audio signals as sound waves.

DETAILED DESCRIPTION

Figure 1:
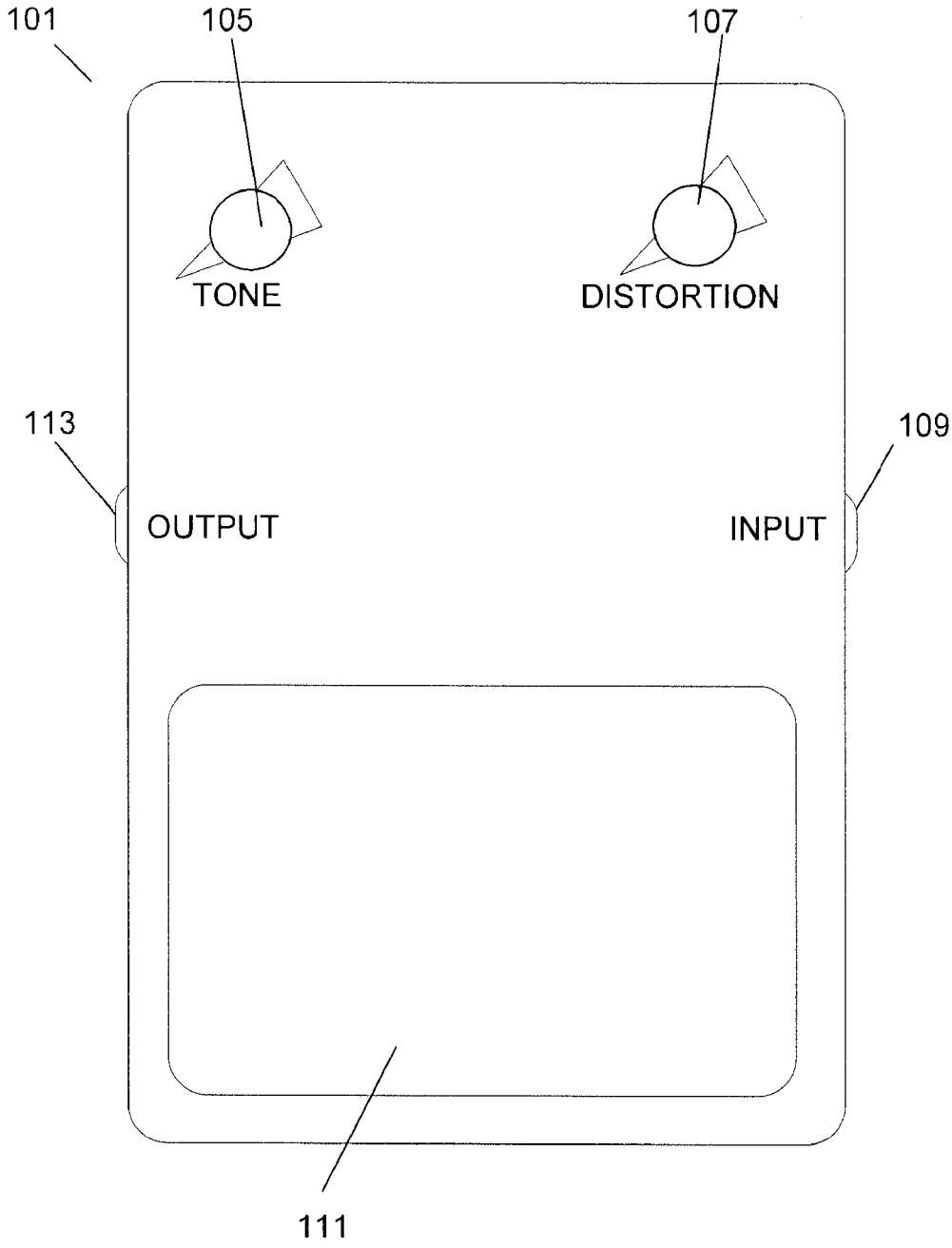
FIG. 1 (PRIOR ART)
FIG. 1 illustrates a top view of a prior art distortion pedal.
Figure 2:
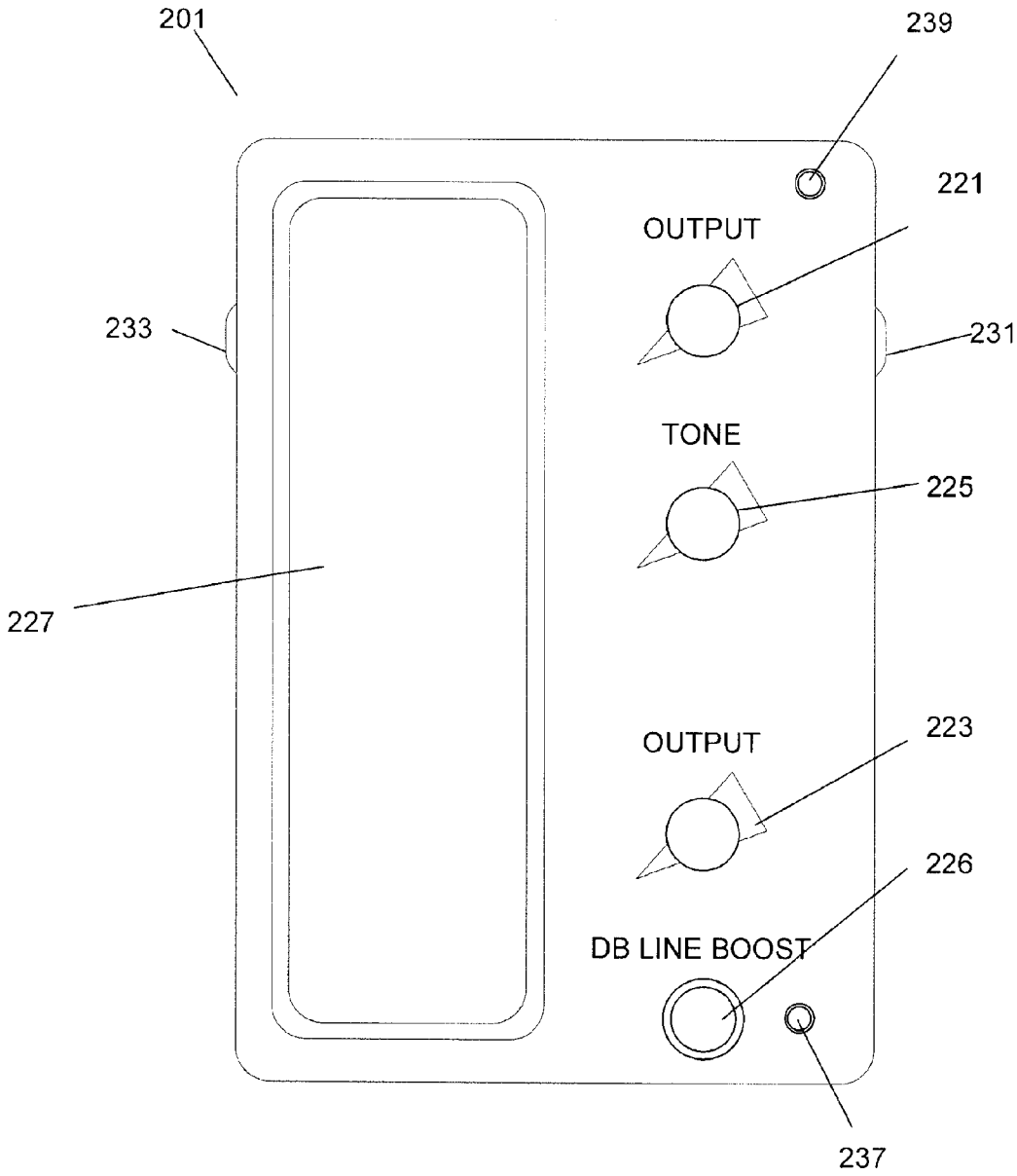
FIG. 2 illustrates a tope view of a distortion pedal with boost.
Figure 3:
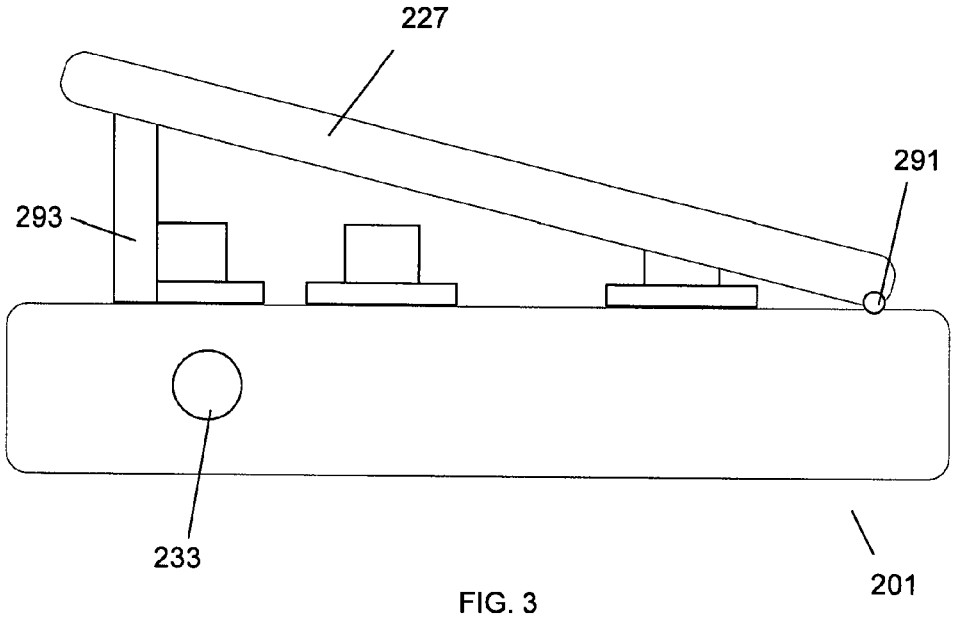
FIGS. 3 and 4 illustrate side views of the distortion pedal with boost.
Figure 4:
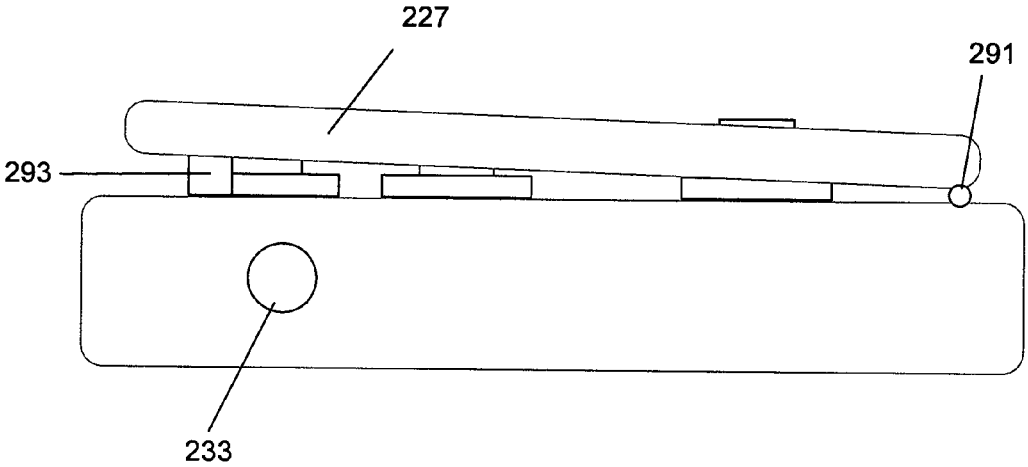

In an embodiment, the inventive distortion pedal includes a foot pedal that allows the user to vary the distortion level rather than simply turning the distortion on or off. With reference to FIG. 2, a top view of an embodiment of the distortion pedal 201 is illustrated and with reference to FIGS. 3 and 4 are side views of an embodiment of the distortion pedal 201. The distortion pedal 201 can include a variable output level control 221, a variable tone/distortion control 225 and a fixed output control 223, a DB line boost switch 226 and DB line boost indicator 237. The distortion pedal 201 also includes a foot pedal 227 that has multiple settings within the movement range, rather than functioning as an on/off switch. The foot pedal 227 may rotate about a hinge 229 and a spring may hold the foot pedal 227 in the fully up position when a downward force is not applied to the foot pedal 227. The distortion pedal 201 also includes an input 231, an output 233 and indicator lights 239.

Rather than functioning as a fixed distortion level unit, the inventive distortion pedal allows the user to adjust the distortion level based upon the distortion pedal 201 position. The movement of the distortion pedal can range from fully back as shown in FIG. 3 to fully depressed as shown in FIG. 4. The foot pedal 227 can be coupled to a hinge or pivot point 291 and a linkage 293 that is pressed into the distortion pedal 201 when the foot pedal 227 is depressed.

The range of distortion controlled by the foot pedal 227 can be controlled by the variable tone/distortion control 225. A high distortion setting will result in a wide range of distortion control by the foot pedal 227 and conversely by setting a low distortion range, the foot pedal 227 may control a smaller range of distortion levels. In an embodiment, the fully back position can cause the least amount of distortion and the fully depressed position can cause the most amount of distortion. In other embodiments, the control by the foot pedal 227 can be reversed with the fully back position resulting in the most amount of distortion and the fully depressed position resulting in the least amount of distortion.

The tone control can consist of a network of highpass, lowpass, and/or bandpass filters. In their most basic form, they attenuate the high or low frequencies of the signal. Active tone controls may also amplify or boost certain frequencies. This is called treble or bass boost or cut, respectively. More elaborate tone control circuits can elevate or attenuate the middle range of frequencies too. The tone control circuits can be passive or active circuits. Passive circuits can utilize resistors, capacitor and/or inductors. The tone control circuit can rely on the property of capacitive reactance or inductive reactance to inhibit or enhance an AC signal, in a frequency-dependent manner. The inductors and capacitors can be used to control different frequencies. For example, capacitors can let more of the higher frequency tones unaltered, while inductors can reduce the amplitude of high frequency tones. In order to boost or cut frequencies in the middle ranges, use is made of the resonance at the frequency at which the reactance of a capacitor equals the reactance of an inductor. In other embodiments, amplifiers can be used to enhance these tone control characteristics. While tone distortion has been described, in other embodiments, different signal distortion processing can be performed by the distortion pedal such as: overdrive, wah, ring modulation, pitch, delay (echo), reverberation, etc.

In addition to tone control the distortion pedal 201 may also include a variable output level the controls the amplification of the input audio signal. In an embodiment, the amplification level may also be controlled by the foot pedal 227. The maximum amplification may occur when the pedal 227 is fully depressed and the minimum amount of amplification may occur when the pedal 227 is full up. In other embodiments, this arrangement may be reversed with maximum amplification with the pedal 227 up and the minimum amplification when the pedal is fully depressed.

In addition to variable amplification, the distortion pedal 201 may also include decibel (DB) line boost amplification. A switch 226 can be controlled by the user's foot to either on/off positions and light 230 may be illuminated to indicate that the DB line boost amplification is on. When switched on, the DB line boost amplification can amplify the input signal regardless of the foot pedal 227 position. In an embodiment, the amplification can be measured in terms of DBs which is a logarithmic unit of measurement that expresses the magnitude of sound pressure. In different embodiments, the amplification can be represented by a maximum DB gain which can be a fixed number such as 6, 10, 40, etc.

Figure 5:
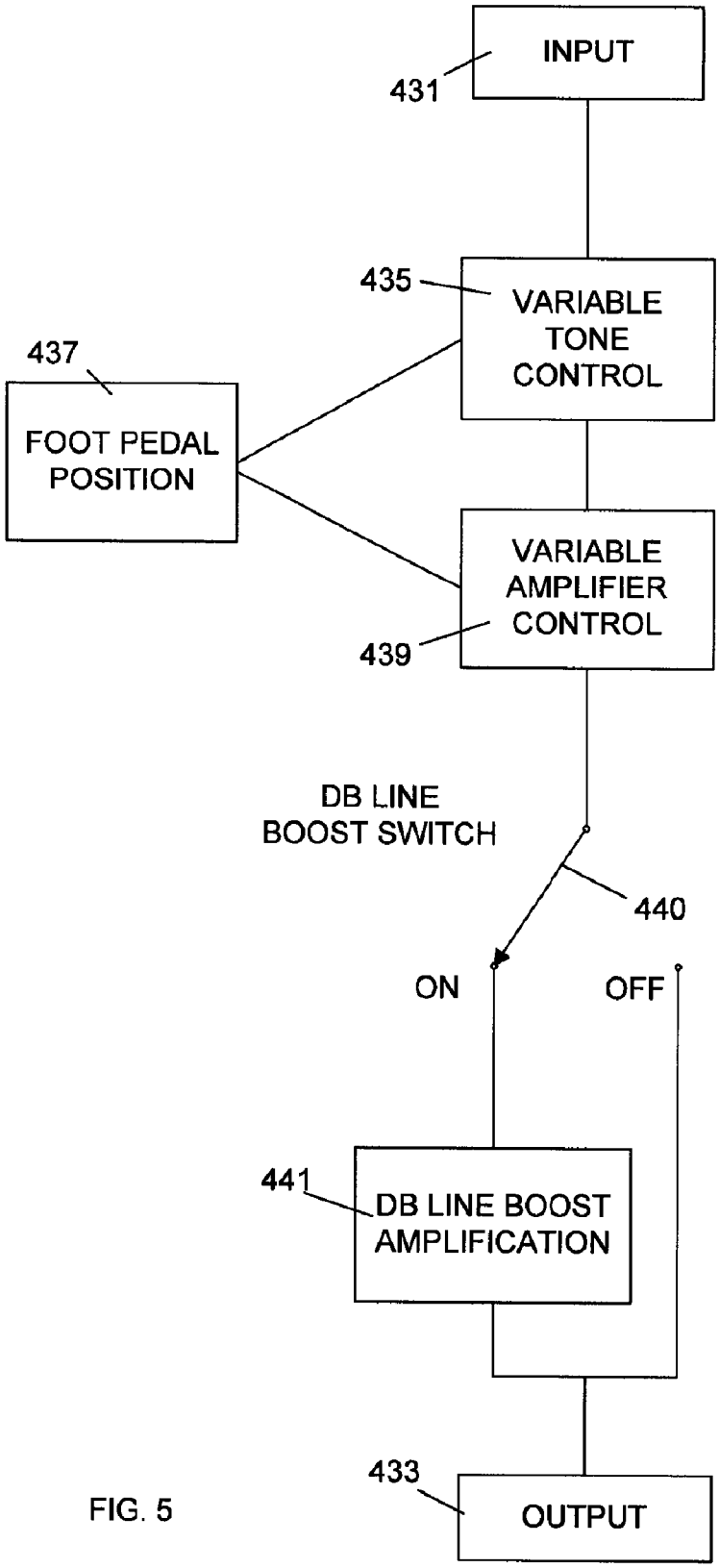
FIG. 5 illustrates a block diagram of the signal processing performed on the audio signals by the distortion pedal.

With reference to FIG. 5, a block diagram of the distortion pedal components is illustrated. An input 431 receives audio signals from a musical instrument such as an electric guitar. The audio signals are processed by the tone control 435 which is controlled by the foot pedal position 437. The distorted audio signals are then processed by a variable amplifier control 439 that is also controlled by the foot pedal position 437. The processed audio signals may then go to a DB line boost amplification 441 and then the output 433. If the DB line switch 440 is not turned on, the audio signals can bypass the BD line boost amplification 441 and go straight to the output 433.

It will be understood that the inventive system has been described with reference to particular embodiments, however additions, deletions and changes could be made to these embodiments without departing from the scope of the inventive system. Although the systems that have been described include various components, it is well understood that these components and the described configuration can be modified and rearranged in various other configurations.

What is claimed is:

1. A distortion pedal comprising:

an input for receiving an audio signal;

a variable tone control for distorting the audio signal;

a variable amplifier control for amplifying the audio signal;

a foot pedal coupled directly to the variable tone control and the variable amplifier control;

an output for emitting the audio signal after processing by the variable tone control and the variable amplifier control; and a tone control adjuster for manually adjusting a maximum distortion value of the variable tone control;

wherein the foot pedal has a range of motion that controls the distortion level of the variable tone control between a minimum distortion value and the maximum distortion value.

2. The distortion pedal of claim 1 further comprising:

a DB line boost amplifier coupled to the variable amplifier control.

3. The distortion pedal of claim 2 further comprising:

a DB line boost switch coupled to the variable amplifier control and the DB line boost amplifier input.

4. The distortion pedal of claim 1 further comprising:

a amplifier control adjuster for manually adjusting a maximum amplification value of the variable amplifier control;

wherein the foot pedal has a range of motion that controls the amplification level of the variable amplifier control between a minimum application value and the maximum amplification value.

* * * * *